US005724628A

United States Patent [19]

Sano

[11] Patent Number: 5,724,628

[45] Date of Patent: Mar. 3, 1998

[54] FIXING DEVICE WITH ENDLESS BELT AND PLURAL HEATERS

[75] Inventor: Eiichi Sano, Takatsuki, Japan

[73] Assignee: Minolta Co., Ltd., Osaka, Japan

[21] Appl. No.: 800,132

[22] Filed: Feb. 13, 1997

[30] Foreign Application Priority Data

Feb. 14, 1996 [JP] Japan ..... 8-026644
Feb. 14, 1996 [JP] Japan ..... 8-026647

[51] Int. Cl.[6] ..... G03G 15/70

[52] U.S. Cl. ..... 399/33; 399/69; 399/329; 219/216; 219/486

[58] Field of Search ..... 399/33, 67, 69, 399/329; 219/216, 486

[56] References Cited

FOREIGN PATENT DOCUMENTS 2-40681 2/1990 Japan .
3-63684 3/1991 Japan .
3-167581 7/1991 Japan .
3-235978 10/1991 Japan .
4-318882 11/1992 Japan .
4-324476 11/1992 Japan .

*Primary Examiner*—Joan H. Pendegrass
*Attorney, Agent, or Firm*—McDermott, Will & Emery

[57] ABSTRACT

A fixing device includes a rotatably supported endless belt and a nip forming member arranged outside the belt in circumferential contact therewith to form a nipping region. Heat generators are arranged adjacent the nipping region. Each heat generator is extended in a transverse direction of the belt, and spaced apart a certain distance from the neighboring one. A controller controls the heat generators so that a temperature of the belt heated by one of heating means is maintained until a subsequent heating.

23 Claims, 9 Drawing Sheets

FIXING DEVICE WITH ENDLESS BELT AND PLURAL HEATERS

FIELD OF THE INVENTION

The invention relates to an improved belt-type fixing device and method for an electrophotographic image forming apparatus as for example copy machine, printer, and facsimile. More especially, the invention relates to a belt-type fixing device and method by which an unfused toner image is heated and then fixed on a sheet substrate such as paper. Further, the invention relates to a heating device for heating a rotatably supported endless belt which is suitably employed, but not limited thereto, in the fixing device in the image forming device.

BACKGROUND OF THE INVENTION

Typically, an electrophotographic multi-color image forming device transfers a plurality of toner images to a sheet in a superimposed registration relationship and then heats to fix the superimposed images on the sheet. At this fixing, a sufficient heat energy should be provided with each toner image, even the lowest one, for heating to firmly fix it onto the sheet. In addition, desired colors in the resultant multi-color image can be presented provided that the superimposed toner images have been heated up to a desired temperature, i.e., an existence of unfused toner prohibits the resultant image from presenting the desired colors.

To overcome this problem, there has been provided a method in which the toner image is additionally heated from the opposite side of the sheet, away from the toner image, and thereby providing the lowermost toner layer with a sufficient heat energy for fusing. This approach, however, can not be practical, because various kinds of sheets, including thick paper, may be actually employed in the image forming device.

Also, especially in a monochrome image, e.g., black-white image, an excessive heating will flatten the surface of the fixed toner image. The flattened toner surface presents a higher glossiness than that of paper, which disadvantageously provides the resultant image with an unwanted and uneven brightness and thereby rendering it difficult to be read.

For these reasons, Japanese Patent Laid-Open Publication No. 2-213888 discloses an improved fixing device in which the heat energy from a heater can be adjusted depending upon the amount of toner to be adhered on the sheet. A firm fixing of the toner image onto the sheet, however, can only be accomplished provided that the toner is heated at a certain temperature or more for a certain period of time and thereby combined with fibers of the sheet. Therefore, the prior art fixing device can hardly present a good fixing property to the toner image, especially, to the multi-layered toner image.

Another type of fixing device has been provided in which a heat roller is employed for heating the unfixed toner image. Generally the heat roller has an increased heat capacity, which requires a relatively long time to heat it up to a desired temperature. This in turn requires the heat roller to be heated even in a standby state for a quick start of the initial image forming, which disadvantageously results in a significant energy consumption.

To reduce the energy consumption, another fixing device has been developed in which an endless belt having a relatively small heat capacity is employed for heating and melting the toner image by the contact therewith. Typically, this belt-type fixing device includes a heater inside the endless belt and a pressure roller outside the same so as to nip the belt therewith.

Further, another belt-type fixing device is provided in which a plurality of transversely extending heat generators are arranged at intervals along the rotational direction of the belt to enlarge the length of a nipping region in which the sheet would be nipped and transported and thereby providing the toner image with the required heat energy for fusing.

Such belt-type fixing device can supply the required heat energy with the toner image on condition that all the heaters can work normally. That is, only one disconnection of the heat generator will lead a shortage of heat energy to be supplied with the toner image, resulting in defective images in which the toner image is not fully fixed to the sheet. In this case, the user of the image forming device has to exchange it for a new one, but if there is no stock, he is prohibited from using the device until the exchange part will come to his hand.

SUMMARY OF THE INVENTION

Accordingly, an object of the invention is to provide an improved belt-type fixing device and its method preferably employed in an electrophotographic image forming device, and another object of the invention is to provide a heating device preferably employed in the fixing device.

To this end, the fixing device of the invention comprises (a) an endless belt;

(b) a plurality of members, arranged inside the belt, for rotatably supporting the endless belt;

(c) drive means for rotating the belt;

(d) nip forming means, arranged outside the belt in circumferential contact therewith to form a nipping region extended a certain length in a rotational direction of the belt, for nipping and transporting the sheet with the belt;

(e) a plurality of heating means, each of the heating means being arranged adjacent the nipping region, extended in a transverse direction of the belt, and spaced apart a certain distance from the neighboring heating means in a rotational direction of the belt;

(f) a plurality of switching means, each switching means switching the associated heating means from a heating state to a non-heating state and vice versa, respectively; and (g) switch control means for controlling the plurality of switching means depending upon the number of toners to be fixed on the sheet;

(h) wherein the distance between the two neighboring heating means is so determined that a temperature of the belt heated by one of the two neighboring heating means is maintained until a subsequent heating by the other.

According to this fixing device, the heat energy to be supplied to the toner image can be adjusted due to the number of toner images to be fixed on the sheet substrate by switching the plurality of heating means spaced apart from each other with respect to the rotational direction of the belt. Also, the distance of the neighboring heating means is so determined that no temperature drop is occurred in the heated belt therebetween and therefore the toner image can be continuously heated at a predetermined temperature or more in the nipping region. As a result, a multi-layered toner image, even the lowermost toner layer, can be provided with sufficient heat energy and thereby fixed firmly on the sheet substrate. Also, no excessive heat energy is applied to the toner image, which results in the resultant image having no difference in glossiness between the fixed toner image and the sheet substrate and thereby easy to be read.

In another aspect of the invention, a fixing device comprises (a) an endless belt;

(b) a plurality of members, arranged inside the belt, for rotatably supporting the endless belt;

(c) drive means for rotating the belt;

(d) nip forming means, arranged outside the belt in circumferential contact therewith to form a nipping region extended a certain length in a rotational direction of the belt, for nipping and transporting the sheet with the belt;

(e) a plurality of heating means, each of the heating means being arranged adjacent the nipping region, extended in a transverse direction of the belt, and spaced apart a certain distance from the neighboring heating means in a rotational direction of the belt;

(f) detecting means for detecting that any of the heating means falls into an inoperable state; and (g) heat control means for controlling each of the plurality of heating means so that, if the detecting means has detected that at least one of the heating means falls into the inoperable state, a heat energy emitted from remaining operable heating means is increased.

Preferably and advantageously, the heat control means increases the heat energy by increasing each heating capacity of the remaining heating means or by decreasing a velocity of transporting the sheet substrate.

More advantageously, the fixing device includes warning means for warning that at least one of the heating means is in the inoperable state.

With this fixing device, when any of the plurality of heating means falls into an inoperable states, it is detected by the detecting means. In this instance, to keep the fixing device in an operable state, the fixing device increases the heat energy to be supplied to the toner image by increasing each heating capacity of the remaining heating means or by decreasing a velocity of transporting the sheet substrate. Thereby, an image forming device having such fixing device can continue its image forming process. Also, by warning that the heating means is in the inoperable state using warning means, the image forming device can provide its users with an information that the heating means should be exchanged.

In another aspect of the invention, a heating device for heating a belt comprises (a) a plurality of heating means, each of the heating means being arranged adjacent the belt, extended in a transverse direction of the belt, and spaced apart a certain distance from the neighboring heating means in a rotational direction of the belt; and (b) a plurality of switching means, each switching means switching the associated heating means from a heating state to a non-heating state and vice versa, respectively;

(c) wherein the distance between the two neighboring heating means is so determined that a temperature of the belt heated by one of the two neighboring heating means is maintained until a subsequent heating by the other.

In another aspect of the invention, a heating device for heating a belt comprises (a) a plurality of heating means, each of the heating means being arranged adjacent the belt, extended in a transverse direction of the belt, and spaced apart a certain distance from the neighboring heating means in a rotational direction of the belt;

(b) detecting means for detecting that any of the heating means is fallen into an inoperable state; and (c) heat control means for controlling each of the plurality of heating means so that, if the detecting means has detected that at least one of the heating means falls into the inoperable state, a heat energy emitted from remaining operable heating means is increased.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

PREFERRED EMBODIMENT OF THE INVENTION

Figure 1:
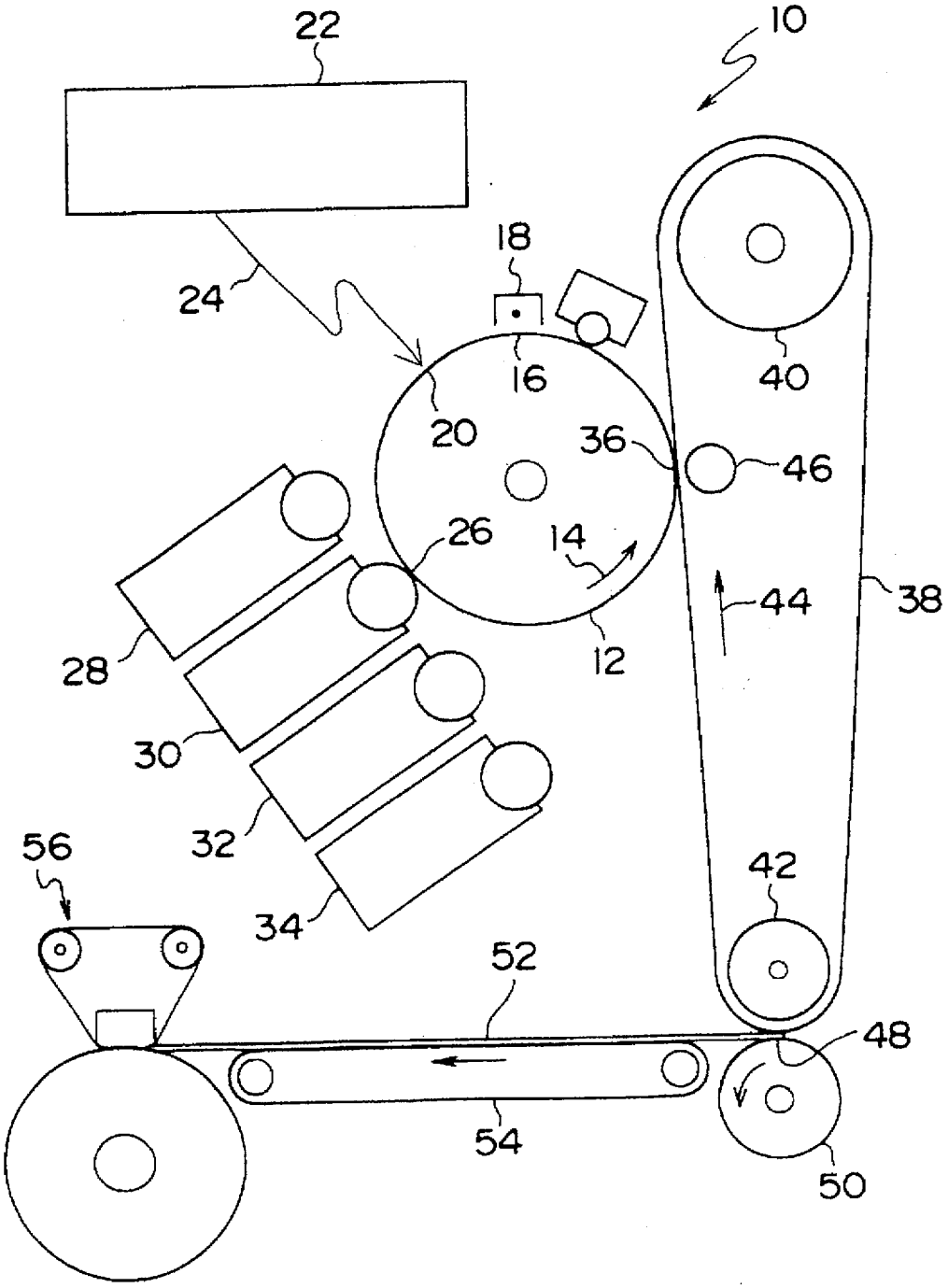
FIG. 1 is a schematic side view of a printer of the invention.

FIG. 1 depicts schematically a full-color or multi-color image forming machine or printer, generally indicated by reference numeral 10. The printer 10 has an electrostatic latent image bearing member or cylindrical photoconductive drum 12 which carries a photosensitive layer on its peripheral surface. Also, the drum 12 is mounted for rotation in the direction indicated by arrow 14. In an operation for reproducing a full-color image by the printer 10, at a charging station 16, successive peripheral portions of the drum 12 are charged to a certain potential by a charger 18. Then, at an exposure station 20, the charged portion of the drum 12 is exposed to a plurality of image lights 24, corresponding to cyan, magenta, yellow, and black images to be reproduced, respectively, projected sequentially from an exposure device 22, to form electrostatic latent images on the drum 12. These latent images are then developed one by one at a development station 26 by associated developers 28, 30, 32, and 34 which include cyan, magenta, yellow, and black toners, respectively, into visualized images. Subsequently, at a first transfer station 36, these visualized toner images are transferred onto a transfer belt 38 in a superimposed registration relationship.

The transfer belt 38 is supported about a pair of upper and lower rollers 40 and 42 for rotation in the direction indicated by arrow 44. Also, a first transfer roller 46 is positioned inside the transfer belt 38 and adjacent the first transfer station 36 so that applying a certain voltage to the first transfer roller 46 permits toner images on the drum 12 to be sequentially transferred onto the transfer belt 38 and thereby superimposed each other. The superimposed toner image is then transferred at a second transfer station 48 onto a sheet 52 which is being nipped and transported by the transfer belt 38 and a second transfer roller 50 arranged in circumferential contact with the transfer belt 38. Next, the superimposed toner image on the sheet 52 is transported by a transporting unit 54 to a fixing device 56 of the invention where it is heated and permanently fixed onto the sheet 52.

Figure 2:
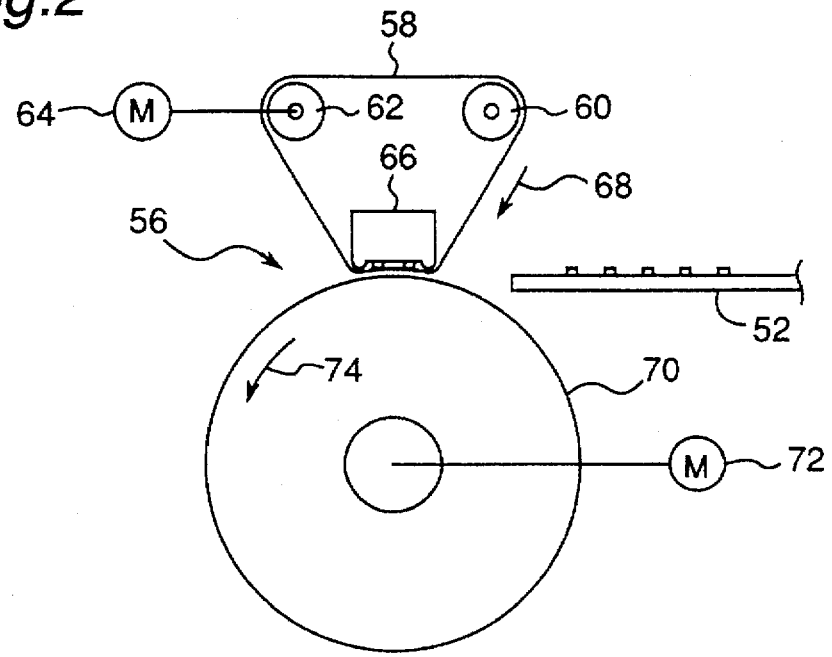
FIG. 2 is a schematic side view of a fixing device incorporated in the printer shown in FIG. 1.
Figure 3:
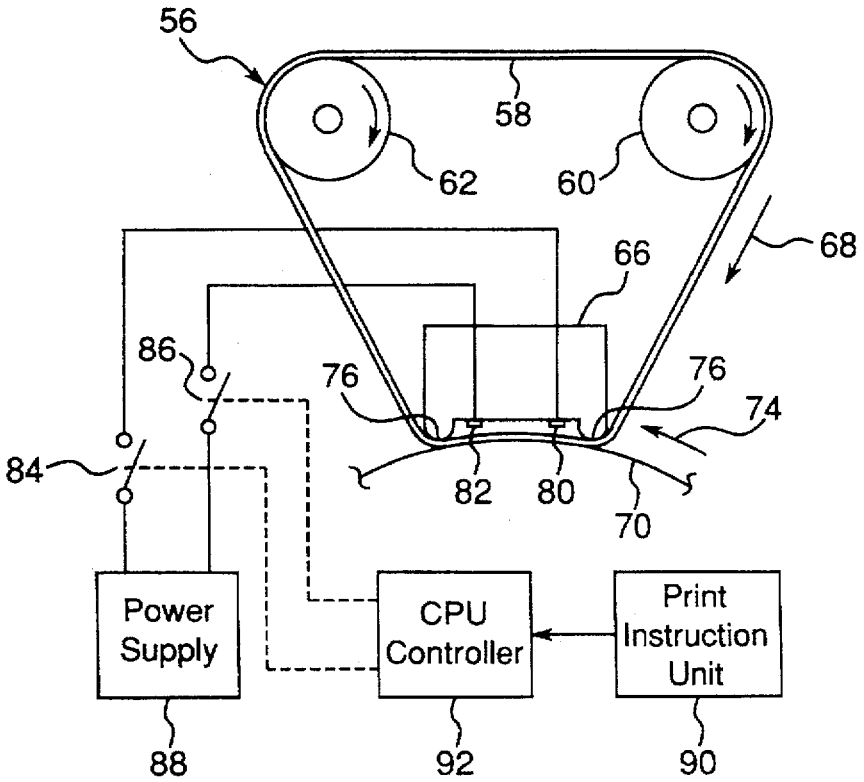
FIG. 3 shows a partial enlarged side view of the fixing device and a control circuit for controlling heat generators.

Referring to FIGS. 2 and 3, the fixing device 56 of the invention comprises an endless fixing belt 58. The belt 58 is supported about a support roller 60, a drive roller 62 drivingly coupled to a drive motor 64, and a heater or heater unit 66, allowing the belt 58 to rotate in the direction of arrow 68 by the drive motor 64. The fixing device 56 further comprises a pressure roller 70 outside the belt 58 to oppose the heater unit 66, in circumferential contact with a portion of the belt 58 which is supported by the heater unit 66. The pressure roller 70 is drivingly coupled to a motor 72 so that successive peripheral surface portions thereof advance in the direction of arrow 74, at the same velocity as that of belt 58.

As shown in detail in FIG. 3, the heater unit 66 comprises a pair of projections 76 so that they can contact with and support the inner peripheral surface portions of the belt 58. Each projection 76 extends in the transverse direction of the belt 58 and is spaced a certain distance away from the other in the circumferential direction of the belt 58. Preferably, each contact portion of the projections 76 is rounded so that the belt 58 runs smoothly thereon. In addition, the heater unit 66 has a pair of heat generators 80 and 82 between the projections 76. Each of the heat generators 80 and 82 extends substantially from one circumferential edge to the opposite of the belt 58.

Figure 5:
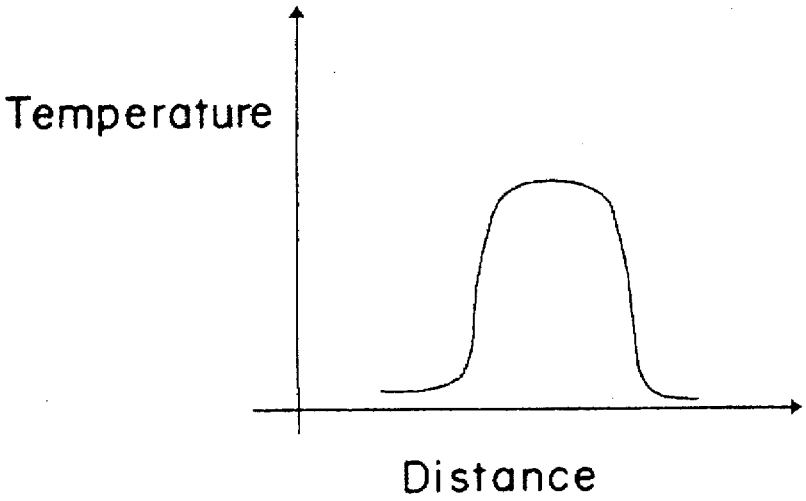
FIG. 5 is a graph of distance versus temperature in an endless fixing belt which shows that a portion of the belt keeps a predetermined temperature or more while moving past a nipping region in the fixing device.
Figure 6:
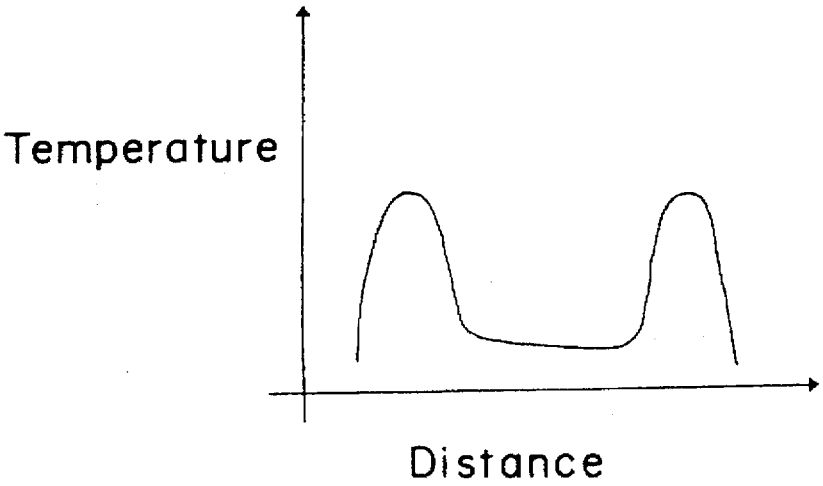
FIG. 6 is a graph of distance versus temperature in the endless fixing belt which shows that the belt portion fails to keep the predetermined temperature while moving the nipping region.

The heat generators 80 and 82 are spaced apart a certain distance from each other. Also, the fixing device 56 is so designed that a portion of the belt 58 firstly heated by the heat generator 80 can maintain a temperature higher than that required for toner fusing before being reheated by the subsequent heat generator 82 as shown in FIG. 5. That is, the belt portion heated by the heat generator 80 is prevented from cooling down below the required temperature for fusing before reaching the subsequent heat generator 82 as shown in FIG. 6. Although this distance should be determined by taking factors, among others, the moving velocity of the belt 58, heating performances of the heat generators 80 and 82 into account, typically it may be less than 20 millimeters, preferably less than 15 millimeters. This ensures that the belt 58 keeps the temperature higher than that required for fusing while moving from the first heat generator 80 to the second heat generator 82.

The heat generators 80 and 82 are electrically coupled via respective switches 84 and 86 to a power supply 88. These switches are turned on and off by a controller 92 based upon an information signal from a print instruction unit 90, the signal indicating whether the image to be reproduced is a single-color image or multi-color image.

Figure 4:
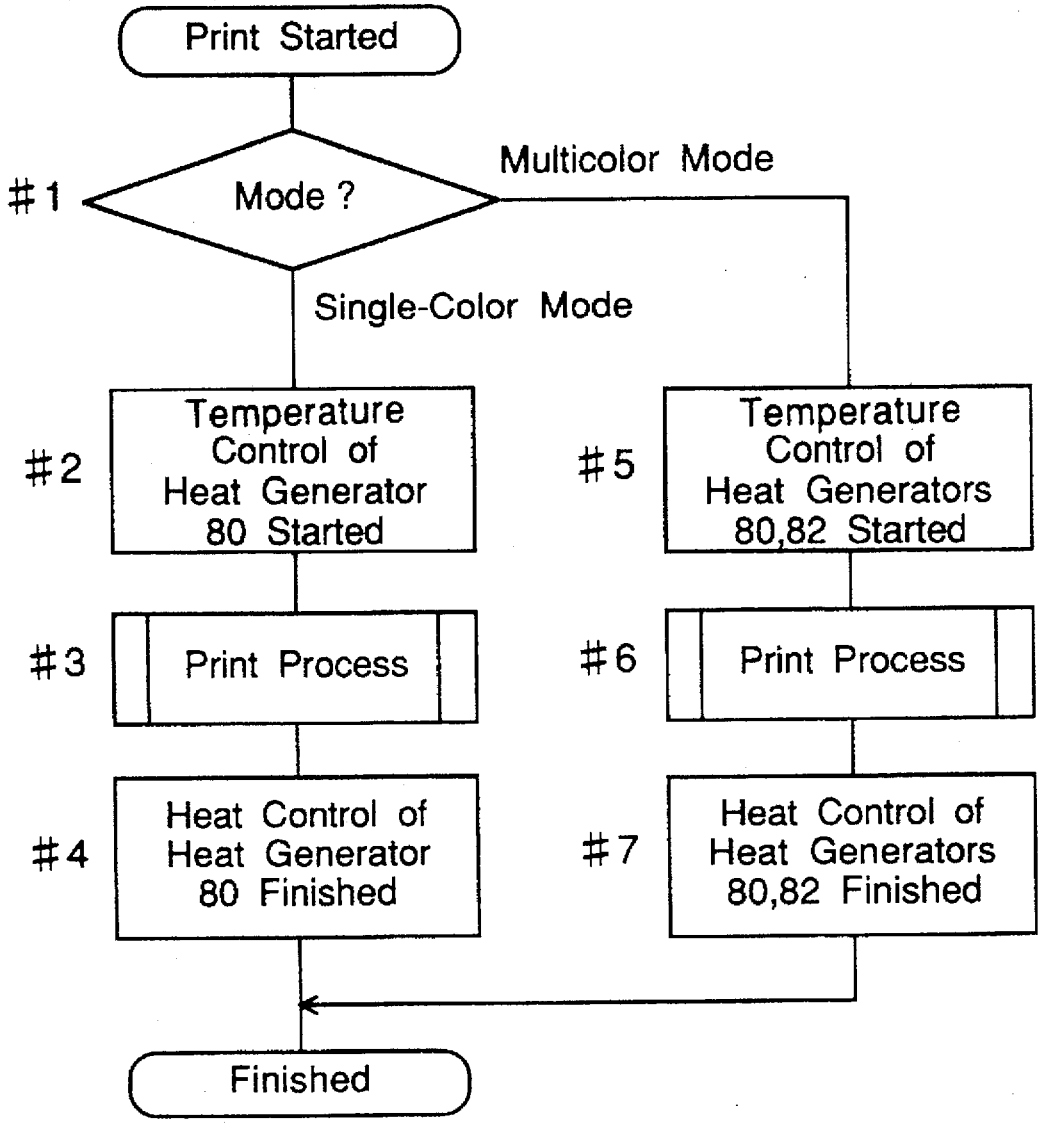
FIG. 4 is a flowchart for controlling the heat generators.

A control process by the controller 92 is illustrated in FIG. 4. In this process, once an instruction to start the image formation is fed out from the print instruction unit 90 to the controller 92, the controller judges at step #1 whether instructed thereto is a single-color print mode or a multi-color print mode. If the single-color print mode has been instructed, the controller 92 turns on the switch 84 and turns off the other switch 86 at step #2 so as to start a temperature controlling of the first heat generator 80 for heating the belt 58 up to a certain temperature required for fusing of the single-color toner image. This temperature should be higher than that required for toner fusing and fixing but lower than that could overheat the toner image and thereby resulting an excessive glossiness thereon. Subsequently, the controller 92 starts the printing process described above at step #3. In this process, the fixing device 56 energizes the motors 64 and 72 to rotate the fixing belt 58 and the pressure roller 70, respectively, in the respective directions of arrows 68 and 74. Thereby, the sheet 52 bearing the unfused toner image is advanced into the nipping region where the fixing belt 58 keeps contact with the pressure roller 70. In this nipping region, the toner image is fused and fixed onto the sheet 52. Finally, if the printing has finished, the controller 92 terminates the temperature control of the heat generator 80 at step #4.

If the multi-color print mode is instructed, firstly, at step #5, the controller 92 turns on both switches 84 and 86 and starts the temperature control therefor. Then, at step #6, the controller 92 energizes the motors 64 and 72 to rotate the fixing belt 58 and the pressure roller 70 in the respective directions, thereby heating the fixing belt 58. The first and second heat generators 80 and 82 keep the temperature of the successive portions of the fixing belt 58 therebetween higher than the certain level as described with FIG. 5. Therefore, the toner image is heated for a relatively long period of time, by which even the lowermost toner layer can fully be fused and fixed onto the sheet 52. Finally, after the sheet 52 has passed through the fixing device 56, the controller 92 terminates the temperature control of the heat generators 80 and 82.

As described, according to the invention, a plurality of superimposed toner images are continuously heated at the temperature necessary for its fusing, allowing even the lowermost toner layer to be fully heated and fixed onto the sheet.

Although the fixing device includes two heat generators, the number of which is not limited thereto and more heat generators may be arranged with leaving a suitable space therebetween. In this instance, each heat generator may be switched on and off depending upon the number of the toner layers in the superimposed image. Also, the number of the heat generators to be switched on and/or the voltage to be applied to the heat generators may be determined according to the types of toners used (e.g., color or composition) and/or the types of sheets used (e.g., thick paper, thin paper or transparent sheet for over-head-projector).

Also, although the fixing belt 58 and the pressure roller 70 are driven by respective motors 64 and 72, the belt 58 and the roller 70 may be driven by a single motor, i.e., motor 64 or 72, by drivingly coupling the belt 58 to the roller 72. This can be equally applied the following embodiments.

Further, when reproducing a single-color image, one or more heat generators may be selectively energized depending upon the toner to be used. For example, typically more glossiness can be provided with the toner surface when using the heat generator positioned on an upstream side rather than when using the heat generator on a downstream side with respect to the moving direction of the sheet. Therefore, preferably the downstream side heat generator is selected for the print by the black color toner while the upstream side heat generator is selected for the print by other color toners.

Alternatively, by employing various kinds of heat generators having different heating performances, changing the levels of electric currents to be applied to the respective heat generators, and/or providing different temperature control levels for respective heat generators, most suitable condition may be selected for black color printing and for other color printing, respectively.

Further, a selection means may be arranged at an operation panel so that the user can select the image having glossiness or the image free from glossiness and, upon such user's selection, most suitable heat generator is selected automatically.

Furthermore, the transparent sheet for over-head-projector and thick paper need greater heat energy for fixing toner thereon. Therefore, when using these sheets, a plurality of heat generator may always be energized to provide sufficient heat energy with both the toner and the sheet, in spite of the type of the toner to be used.

Figure 7:
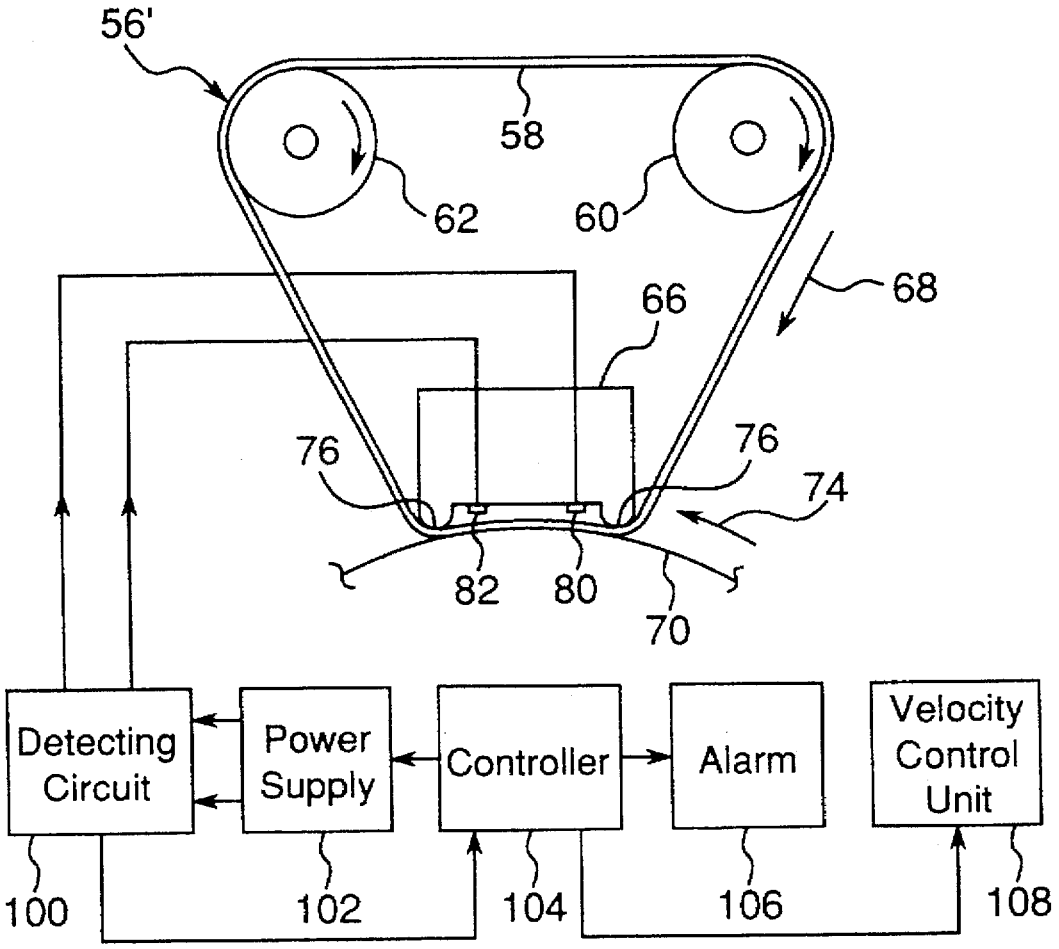
FIG. 7 shows a schematic side view of a fixing device of the second embodiment and its controlling circuit.

Referring to FIG. 7 in which the fixing device of a second embodiment according to the invention, generally indicated by reference numeral 56', is depicted. The fixing device 56' of this embodiment can be utilized in the printer 10 shown in FIG. 1 in the same manner as the fixing device 56 of the first embodiment. Also, each part and its structure which would not describe in detail in this embodiment are similar to those in the previous embodiment and therefore like parts are designated by like reference numerals.

In this fixing device 56', the heat generators 80 and 82 are electrically connected via a detecting circuit 100 to a power supply 102 so that they can be supplied with a standard voltage (i.e., low voltage) or another voltage (i.e., high voltage) higher than that. The power supply 102 is communicated with a control circuit or controller 104 so that the output from the power supply 102 to the heat generators 80 and 82 can be switched on and off by the controller 104, respectively. The detecting circuit 100 detect the respective electric currents supplied from the power supply 102 to the heat generators 80 and 82 so that, if the both or either heat generator 80 or 82 falls into an inoperable state due to its breakdown, a predetermined signal is fed to the controller 104. The controller 104 is also communicated with an alarm 106 so that, if the both or either heat generator 80 or 82 falls into the inoperable state, which is detected by the detecting circuit 100, the predetermined signal is output for activating the alarm 106 to warn the breakdown of the same. The alarm 106 may be a display panel typically equipped on the image forming machine, a voice unit such as buzzer, or both.

Figure 8:
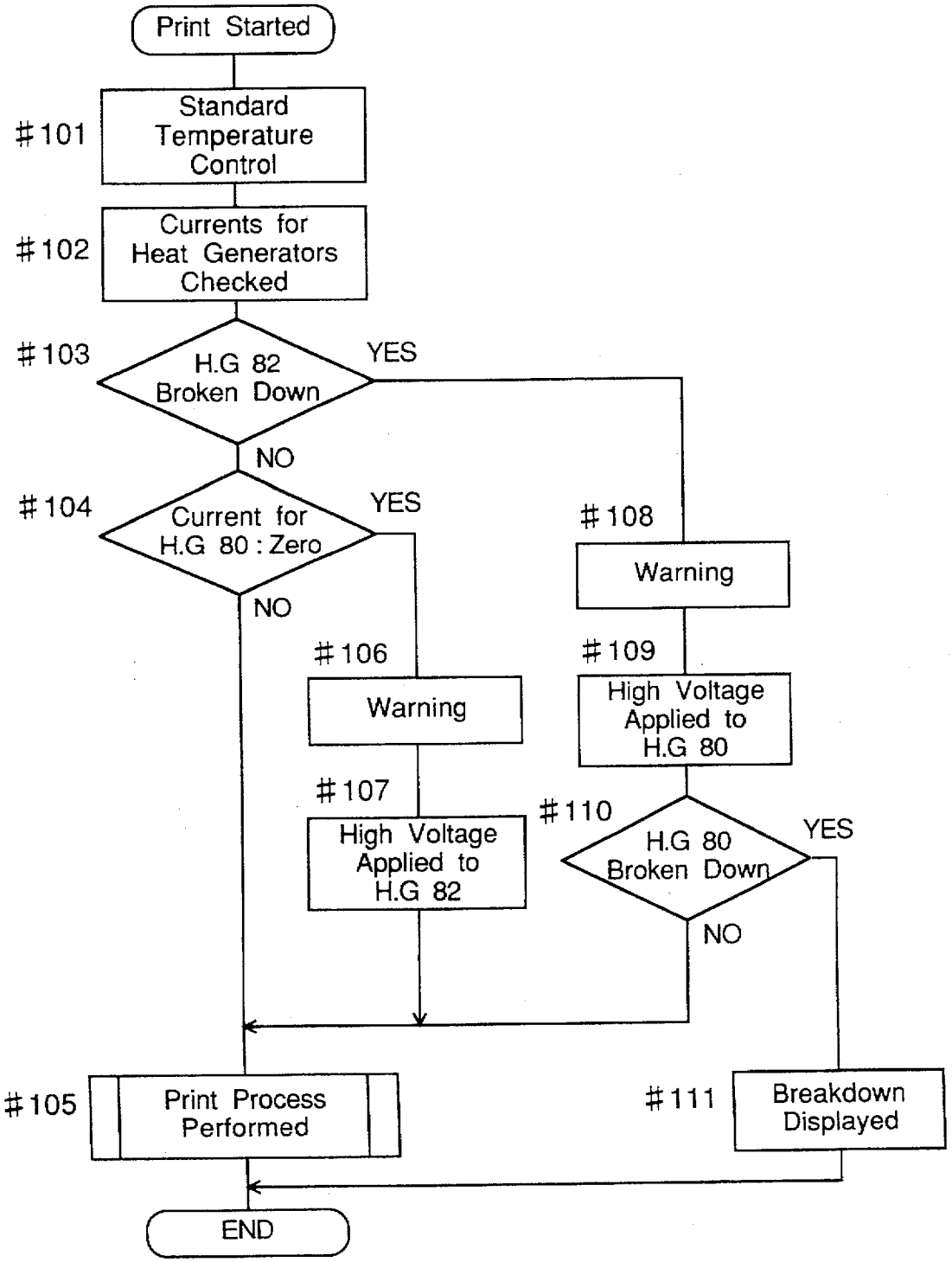
FIG. 8 is a flowchart for controlling the fixing device of the second embodiment.

Next, with reference to FIG. 8, the temperature control of this device 56', particularly the temperature control of when the heat generator is breakdown, will be described. In this control, once the printing has started, a standard temperature control which is performed when both heat generators 80 and 82 are normal is commenced at step #101, thereby allowing the heat generators 80 and 82 to heat the fixing belt 58 for heating and melting the toner images. Then, at step #102, the controller 104 checks the respective electric currents being supplied to the heat generators 80 and 82, based on the output of the detecting circuit 100. Subsequently, the controller 104 judges at steps #103 and #104 whether no electric current is flowing to either or both heat generators 80 and 82, i.e., either or both heat generators has broken down. At this time, if the electric current is flowing in both heat generators 80 and 82, i.e., if the controller 104 has determined at step #105 that neither of the heat generators 80 or 82 was broken down, a normal printing process is performed.

If, however, it is determined at step #104 that the heat generator 80 is broken down, the controller 104 activates the alarm 106 to warn the user of the breakdown in the heat generator 80 to exchange it for a new one at step #106. Also, at step #107, the controller 104 instructs the power supply 102 to change the voltage to be applied to the other living heat generator 82 from the standard voltage (low voltage) to the high voltage. This increases the heat energy emitted from the heat generator 82 to compensate a heat shortage which would otherwise be caused by the breakdown of the heat generator 80, which ensures the toner to be fully fused and fixed on the sheet.

Contrary to this, it is determined at step #103 that the heat generator 82 is broken down, the controller 104 activates the alarm 106 to warn the user of the breakdown in the heat generator 82 to exchange it for a new one at step #108. Then, at step #109, the controller 104 instructs the power supply 102 to change the voltage to be applied to the other living heat generator 80 from the standard voltage to the high voltage. This increases the heat energy emitted from the heat generator 80 to compensate a heat shortage which would otherwise be caused by the breakdown of the heat generator 82, which ensures the toner to be fully fused and fixed on the sheet.

Further, if it is determined at step #110 that both heat generators are broken down, the alarm 106 displays the breakdown in the fixing device 56 at step #111.

The level of high voltage to be applied to the living heat generators 80 or 82 when the remaining is dead is so determined that the living heat generator 80 or 82 can provide the toner with more heat energy than required for toner fusing and thereby providing the resultant image with an allowable quality. That is, the high voltage needs not to be the one required for providing the toner with heat energy identical to that supplied at the normal state (i.e., neither heat generator being broken down).

Although in the previous embodiment the full toner-fusing is secured by changing the voltage to be applied to the living heat generator 80 or 82 from standard to high level if the remaining heat generator is broken down, the transporting speed of the sheet in the fixing device 56' may be decreased from a standard to a lower level and thereby increasing the heat energy to be supplied per unit time with the sheet.

Figure 9:
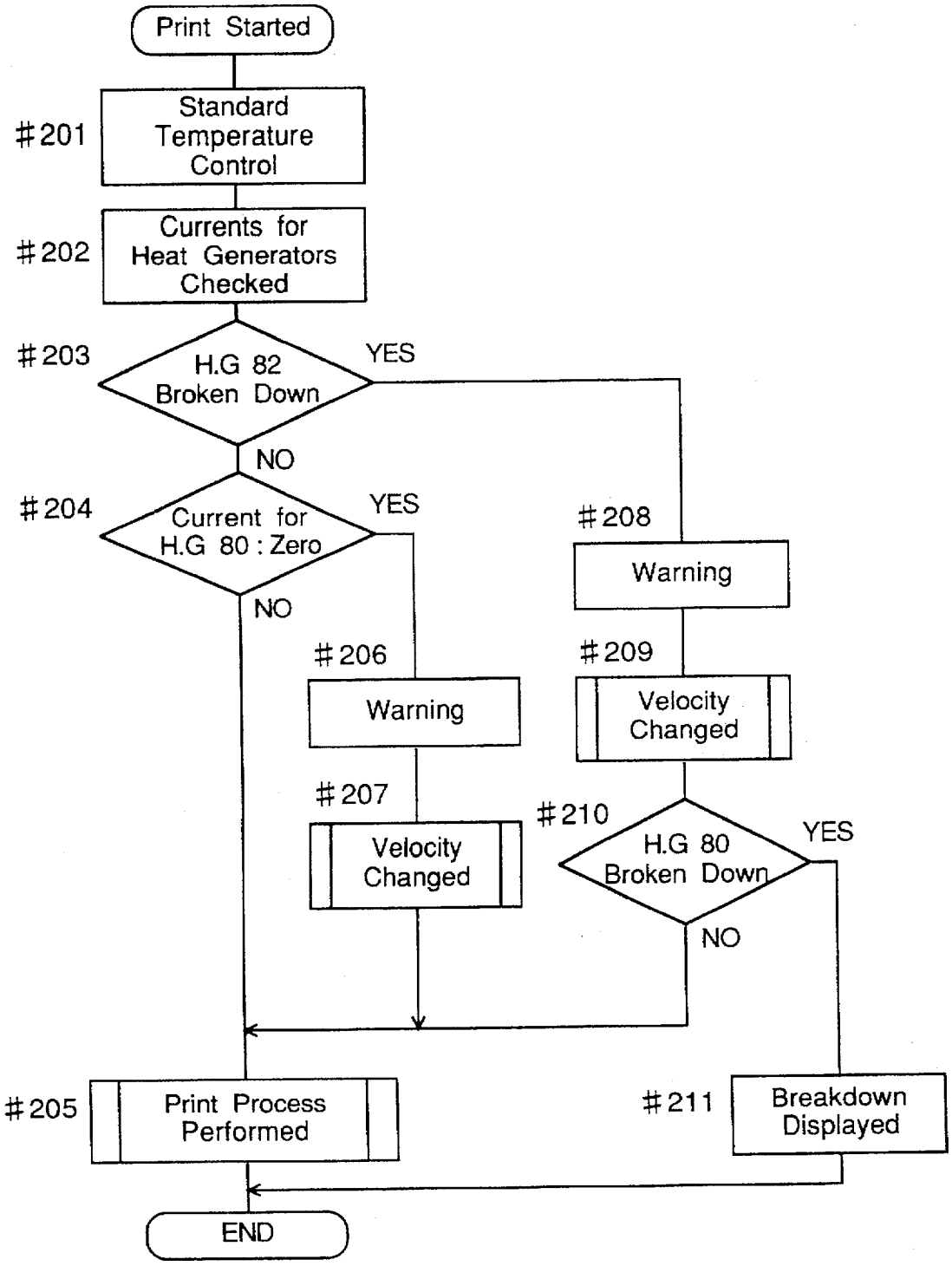
FIG. 9 is also a flowchart for controlling the fixing device of the second embodiment.
Figure 10:
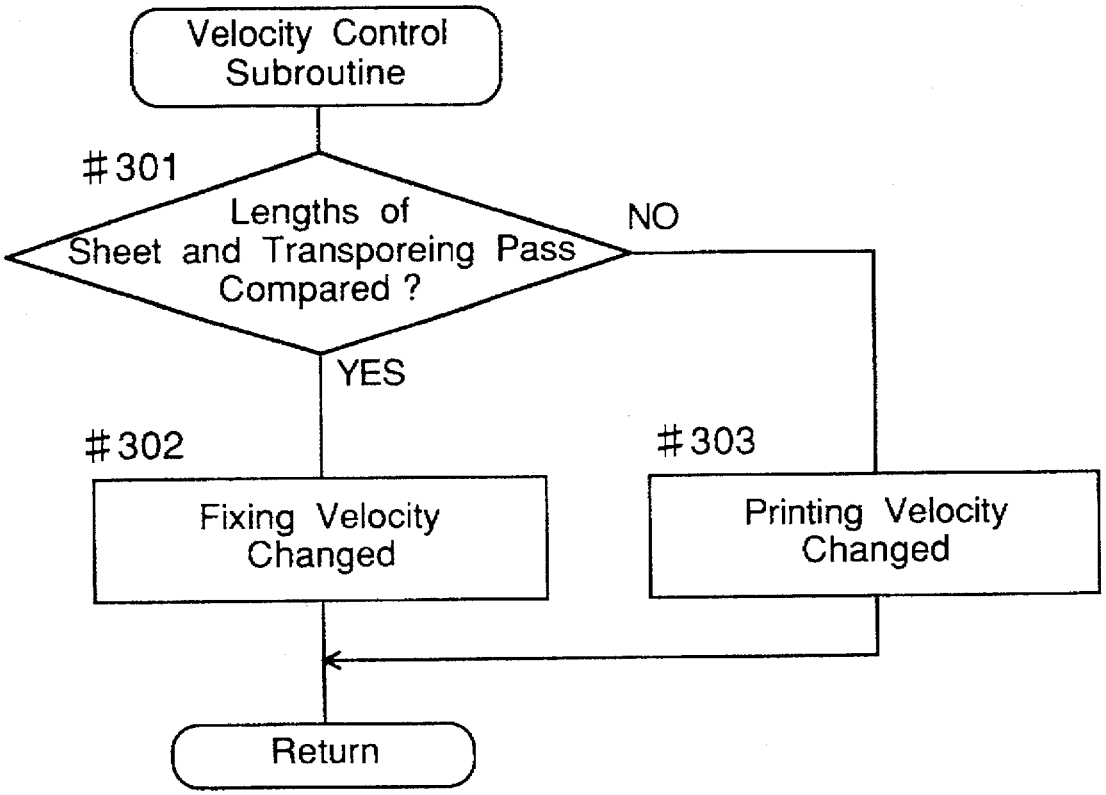
FIG. 10 is a flowchart of a velocity control subroutine of the flowchart shown in FIG. 9.

This velocity control is illustrated in flowcharts of FIGS. 9 and 10. Although control processes in FIG. 9 are similar to those in FIG. 8, some processes in steps #207 and #209 differ from those in steps #107 and #109. That is, remaining processes in steps #201 to #206, #208, #210, and #211 correspond to those in steps #101 to #106, #108, #110, and #111, respectively, discussions will not be made to these processes.

Also, to perform the velocity control, a velocity control mechanism is required, by which the rotational velocities, not only of the motors 64 and 72 for driving the fixing device but also of a main motor for driving the transporting unit 54, photoconductive drum 12, and transfer belt 38, can be changed from a low level to a high level and vice versa.

Additionally, as shown in FIG. 7, there is provided a velocity control unit 108 controlled by the controller 104.

In the velocity control shown in FIGS. 9 and 10, the process in step #207 provides the velocity control when the heat generator 80 is broken down and the process in step #209 provides the velocity control when the other heat generator 82 is broken down. These processes are performed in a velocity control subroutine shown in FIG. 10.

In this subroutine, firstly, an element in which the sheet transporting velocity is to be changed is determined depending upon the length of sheet with respect to the sheet transporting direction at step #301. In this determination, compared is the length of the sheet along the sheet transporting direction and the length of a transporting pass of the sheet, i.e., the length from the transfer station 48 to the entrance of the nipping region in the fixing device.

If the sheet length along the transporting direction is shorter than the transporting pass length, after the sheet to which the toner was transferred has completely passed the transfer station 48, the sheet transporting velocity of the transporting unit 54 and the fixing velocity of the fixing device, i.e., rotational speeds of the motors 64 and 72, are changed from a standard to a low-speed level at step #302. This causes the sheet to be transported at a low velocity. As a result, the sheet and the toner supported thereon are heated slowly by the heat generator, providing the toner with sufficient heat energy for fusing.

If the sheet length along the transporting direction is longer than the transporting pass length, it might happen that the tailing edge of the sheet has not passed the transfer station 48 while the leading edge thereof has already reached the fixing device. In this case, the controller 104 changes the velocity of the printing system from the standard to the lower state at step #303. Thus, the sheet and the toner supported thereon are heated slowly by the heat generator, providing the toner with sufficient heat energy for fusing.

It should be noted that the low velocity to be set when the heat generator 80 or 82 is broken down is so determined that the living heat generator 80 or 82 can provide the toner with more heat energy than required for toner fusing and thereby simply providing the resultant image with an allowable quality. That is, the low velocity needs not to be the one required for providing the toner with heat energy identical to that supplied at the normal state (i.e., neither heat generator being broken down).

Figure 11:
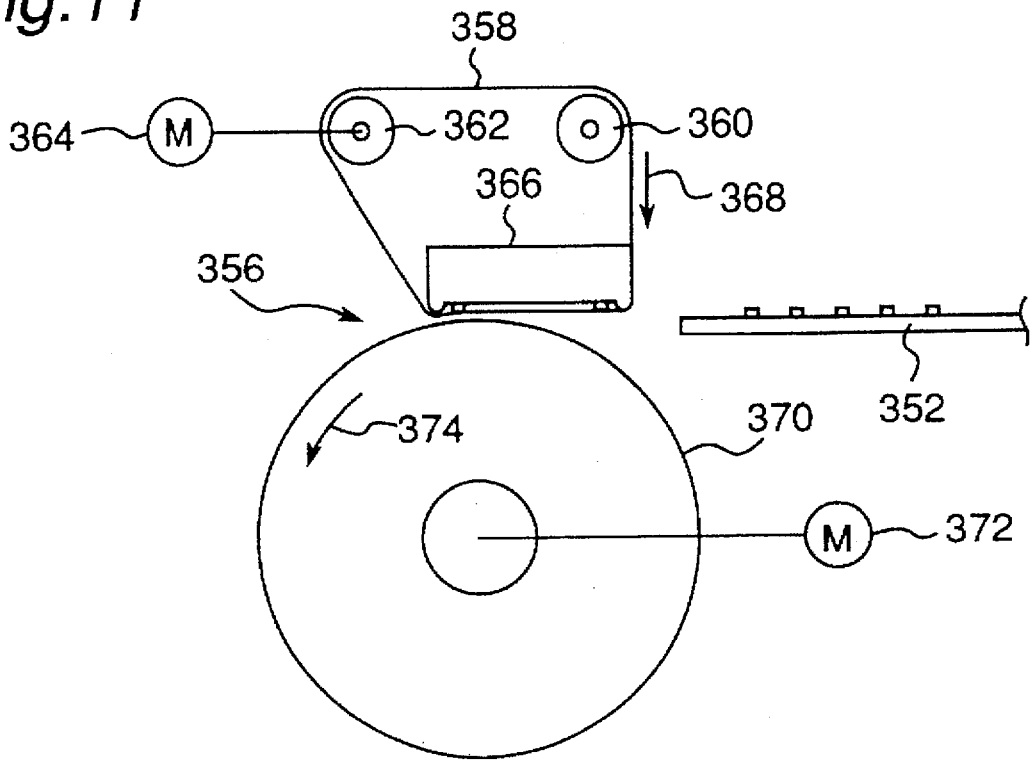
FIG. 11 is a schematic side view of a fixing device of another embodiment.
Figure 12:
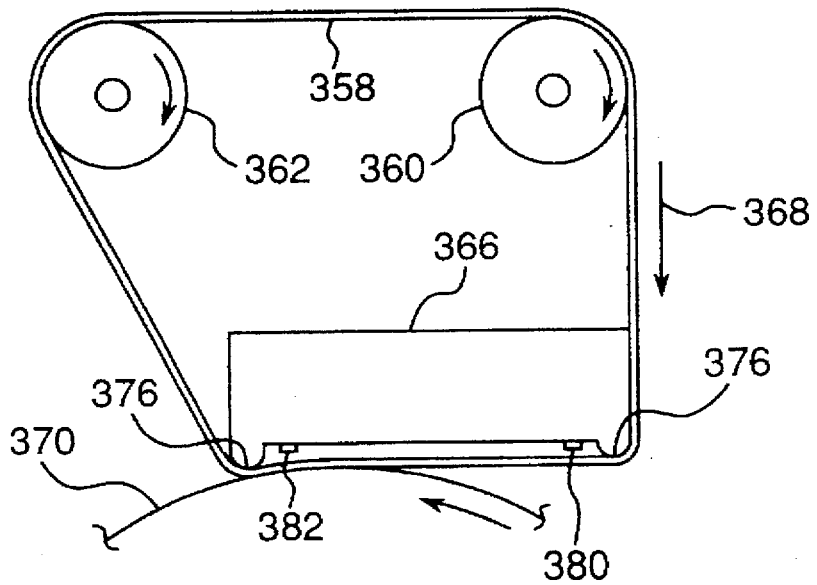
FIG. 12 is an enlarged side view of the fixing device shown in FIG. 11.

FIGS. 11 and 12 depict another embodiment of the invention in which various parts corresponding to those in FIGS. 2 and 3 are designated by reference numerals to which three hundreds are added. In this fixing device 356, the heater unit 366 is extended along the sheet transporting direction, i.e., horizontally in this embodiment. Also, only the projection 376 positioned on the downstream side with respect to the sheet transporting direction is forced on the pressure roller 370 via the fixing belt 358 and the other projection 376 positioned on the upstream side is spaced apart from the pressure roller 370. With this fixing device 356, before entering into the contact region of the fixing belt 358 and the pressure roller 370, the sheet 352 and the unfused toner image are pre-heated by a heat radiation of the portion of the fixing belt 358 which has heated by the heat generator 380. The pre-heated toner is then heated again at the contact region by the contact of the heated fixing belt 358 and thereby melted and fixed on the sheet 352.

Next, discussions will be made to a control which is performed if the heat generator 380 or 382 in the fixing device 356 is broken down. For example, if the heat generator 380 is broken down, the voltage to be applied to the other living heat generator 382 is changed to a high level (first high level) to increase the heat energy emitted from the heat generator 382, thereby compensating the shortage which would otherwise be caused by the breakdown of the heat generator 380. The heat increase should be so determined that the toner can be fused and then fixed on the sheet.

Contrary, if the heat generator 382 is broken down, the voltage to be applied to the other living heat generator 380 is changed to another high level (second high level) to increase the heat energy emitted from the heat generator 380. In this case, however, the portion of the belt 358 adjacent the living heat generator 380 does not contact with the sheet 352. Therefore, the second high level voltage should be greater than the first high level so that the heat generator 380 can emit greater heat energy than that emitted from heat generator 382 when the heat generator 380 is broken down.

Although descriptions have been made to heat control when the heat generator or generators are broken down, the present invention can be applied if the heat generator or generators fall into an inoperable state due to other reasons.

Also, the invention described in the second embodiment can be incorporated into the first embodiment.

The invention has been disclosed in its most preferred embodiments, and it is clear that it susceptible to numerous modifications and embodiments within the ability of those skilled in the art and without the exercise of the inventive faculty. Accordingly, the scope of the invention is defined by the scope of the following claims.

What is claimed is:

1. A fixing device for use in an image forming apparatus, by which one or more toner images are fixed on a sheet substrate, comprising:

(a) an endless belt;

(b) a plurality of members, arranged inside the belt, for rotatably supporting the endless belt;

(c) drive means for rotating the belt;

(d) nip forming means, arranged outside the belt in circumferential contact therewith to form a nipping region extended a certain length in a rotational direction of the belt, for nipping and transporting the sheet with the belt;

(e) a plurality of heating means, each of the heating means being arranged adjacent the nipping region, extended in a transverse direction of the belt, and spaced apart a certain distance from the neighboring heating means in a rotational direction of the belt;

(f) a plurality of switching means, each switching means switching the associated heating means from a heating state to a non-heating state and vice versa, respectively; and (g) switch control means for controlling the plurality of switching means depending upon the number of toners to be fixed on the sheet;

(h) wherein the distance between the two neighboring heating means is so determined that a temperature of the belt heated by one of the two neighboring heating means is maintained until a subsequent heating by the other.

2. A fixing device claimed in claim 1, further comprising:

detecting means for detecting that any of the heating means falls into an inoperable state; and heat control means for controlling each of the plurality of heating means so that, if the detecting means has detected that at least one of the heating means falls into the inoperable state, a heat energy emitted from the remaining operable heating means is increased.

3. A fixing device claimed in claim 2, wherein the heat control means increases the heat energy by increasing each heating capacity of the remaining heating means.

4. A fixing device claimed in claim 2, wherein the heat control means increases the heat energy by decreasing a velocity of transporting the sheet substrate.

5. A fixing device claimed in claim 2, further comprises warning means for warning that at least one of the heating means has broken down.

6. A fixing device for use in an image forming apparatus, by which a toner image supported on a sheet substrate is heated and fixed on the sheet substrate, comprising:

(a) an endless belt;

(b) a plurality of members, arranged inside the belt, for rotatably supporting the endless belt;

(c) drive means for rotating the belt;

(d) nip forming means, arranged outside the belt in circumferential contact therewith to form a nipping region extended a certain length in a rotational direction of the belt, for nipping and transporting the sheet with the belt;

(e) a plurality of heating means, each of the heating means being arranged adjacent the nipping region, extended in a transverse direction of the belt, and spaced apart a certain distance from the neighboring heating means in a rotational direction of the belt;

(f) detecting means for detecting that any of the heating means falls into an inoperable state; and (g) heat control means for controlling each of the plurality of heating means so that, if the detecting means has detected that at least one of the heating means falls into the inoperable state, a heat energy emitted from remaining operable heating means is increased.

7. A fixing device claimed in claim 6, wherein the heat control means increases the heat energy by increasing each heating capacity of the remaining heating means.

8. A fixing device claimed in claim 6, wherein the heat control means increases the heat energy by decreasing a velocity of transporting the sheet substrate.

9. A fixing device claimed in claim 6, further comprises warning means for warning that at least one of the heating means falls into the inoperable state.

10. A heating device for heating a belt, comprising:

(a) a plurality of heating means, each of the heating means being arranged adjacent the belt, extended in a transverse direction of the belt, and spaced apart a certain distance from the neighboring heating means in a rotational direction of the belt; and (b) a plurality of switching means, each switching means switching the associated heating means from a heating state to a non-heating state and vice versa, respectively;

(c) wherein the distance between the two neighboring heating means is so determined that a temperature of the belt heated by one of the two neighboring heating means is maintained until a subsequent heating by the other.

11. A heating device claimed in claim 10, further comprising:

detecting means for detecting that any of the heating means falls into an inoperable state; and heat control means for controlling each of the plurality of heating means so that, if the detecting means has detected that at least one of the heating means falls into the inoperable state, a heat energy emitted from the remaining operable heating means is increased.

12. A heating device claimed in claim 11, wherein the heat control means increases the heat energy by increasing each heating capacity of the remaining heating means.

13. A heating device claimed in claim 11, wherein the heat control means increases the heat energy by decreasing a rotational velocity of the belt.

14. A heating device claimed in claim 11, further comprises warning means for warning that at least one of the heating means falls into the inoperable state.

15. A heating device for heating a belt, comprising:

(a) a plurality of heating means, each of the heating means being arranged adjacent the belt, extended in a transverse direction of the belt, and spaced apart a certain distance from the neighboring heating means in a rotational direction of the belt;

(b) detecting means for detecting that any of the heating means falls into an inoperable state; and (c) heat control means for controlling each of the plurality of heating means so that, if the detecting means has detected that at least one of the heating means falls into the inoperable state, a heat energy emitted from remaining operable heating means is increased.

16. A heating device claimed in claim 15, wherein the heat control means increases the heat energy by increasing each heating capacity of the remaining heating means.

17. A heating device claimed in claim 15, wherein the heat control means increases the heat energy by decreasing a rotational velocity of the belt.

18. A heating device claimed in claim 15, further comprises warning means for warning that at least one of the heating means has broken down.

19. A method for heating and fixing a toner image on a sheet substrate, comprising:

(a) providing a fixing device, the fixing device including an endless belt;

a plurality of members, arranged inside the belt, for rotatably supporting the endless belt;

drive means for rotating the belt;

nip forming means, arranged outside the belt in circumferential contact therewith to form a nipping region extended a certain length in a rotational direction of the belt, for nipping and transporting the sheet with the belt;

a plurality of heating means, each of the heating means being arranged adjacent the nipping region, extended in a transverse direction of the belt, and spaced apart a certain distance from the neighboring heating means in a rotational direction of the belt; and a plurality of switching means, each switching means switching the associated heating means from a heating state to a non-heating state and vice versa, respectively;

(b) controlling the plurality of switching means depending upon the number of toners to be fixed on the sheet; and (c) maintaining a temperature of the belt heated by one of the two neighboring heating means until a subsequent heating by the other.

20. A method for heating and fixing a toner image on a sheet substrate, comprising:

(a) providing a fixing device, the fixing device including an endless belt;

a plurality of members, arranged inside the belt, for rotatably supporting the endless belt;

drive means for rotating the belt;

nip forming means, arranged outside the belt in circumferential contact therewith to form a nipping region extended a certain length in a rotational direction of the belt, for nipping and transporting the sheet with the belt; and a plurality of heating means, each of the heating means being arranged adjacent the nipping region, extended in a transverse direction of the belt, and spaced apart a certain distance from the neighboring heating means in a rotational direction of the belt;

(b) detecting that any of the heating means falls into an inoperable state; and (c) controlling each of the plurality of heating means so that, if it has detected in the step (b) that at least one of the heating means falls into the inoperable state, a heat energy emitted from remaining operable heating means is increased.

21. A method claimed in claim 20, wherein the heat energy is increased by increasing each heating capacity of the remaining heating means.

22. A method claimed in claim 20, wherein the heat energy is increased by decreasing a velocity of transporting the sheet substrate.

23. A method claimed in claim 20, further comprising: warning that at least one of the heating means has broken down.

* * * * *